US006048274A

United States Patent [19]

Lesage

[11] Patent Number: 6,048,274

[45] Date of Patent: Apr. 11, 2000

[54] APPARATUS FOR PERFORMING GOLF-RELATED TASKS

[76] Inventor: James Grant Christopher Lesage, 7140 E. 8th St., Tulsa, Okla. 74112

[21] Appl. No.: 09/122,358

[22] Filed: Jul. 24, 1998

[51] Int. Cl.[7] ..... A63B 57/00

[52] U.S. Cl. ..... 473/286; 172/378

[58] Field of Search ..... 473/282–286, 473/408; 172/378

[56] References Cited

U.S. PATENT DOCUMENTS

| | | | |
|---|---|---|---|
| 3,791,652 | 2/1974 | Schuler | 473/286 |
| 4,380,337 | 4/1983 | DiMatteo | 473/285 |
| 4,805,911 | 2/1989 | Ferlazzo | 473/282 |
| 4,822,052 | 4/1989 | Dimmick | 473/285 |
| 5,007,685 | 4/1991 | Beach | 299/85.2 |
| 5,029,854 | 7/1991 | Laskowitz | 473/407 |
| 5,209,469 | 5/1993 | Laskowitz | 473/407 |
| 5,423,543 | 6/1995 | Tarrant | 473/286 |

*Primary Examiner*—Jeanette Chapman
*Assistant Examiner*—Stephen L. Blau
*Attorney, Agent, or Firm*—Fellers, Snider, Blankenship, Bailey & Tippens

[57] ABSTRACT

An apparatus for facilitating turf repair and/or other golf-related tasks comprising: a plug positionable in a distal end of a golf club shaft and having an aperture extending into an end of the plug; a tool; and a tool shaft extending from the tool and having a distal end portion removably receivable in the aperture. The distal end portion of the tool shaft has a configuration and the aperture has an interior shape corresponding to said configuration such that, when the distal end portion of the tool shaft is received in the aperture, the tool is prevented from rotating with respect to the plug.

16 Claims, 2 Drawing Sheets

APPARATUS FOR PERFORMING GOLF-RELATED TASKS

FIELD OF THE INVENTION

The present invention relates to devices for performing turf repair and other golf-related tasks. More particularly, but not by way of limitation, the present invention relates to turf repair devices which are or can be incorporated in golf clubs.

BACKGROUND OF THE INVENTION

Numerous devices incorporated in golf clubs and useful for facilitating certain golf-related tasks are known in the art. U.S. Pat. No. 3,791,652 discloses a "Dimple Mark Repair Device and Ball Marker Combination With Golf Club." U.S. Pat. No. 4,787,632 discloses a "Golf Club Accessory for Retrieving a Golf Ball." U.S. Pat. No. 4,858,925 discloses a "Golf Club Combined with Ball Position Marker." U.S. Pat. No. 4,892,314 discloses a "Golf Putter with Detachable Divot Mender Stored in Grip." U.S. Pat. No. 4,925,190 discloses a "Combination Golf Club and Turf Repair Tool." U.S. Pat. No. 4,951,951 discloses a "Turf Fixing Putter." U.S. Pat. No. 5,102,139 discloses a "Golf Club Retriever and Marker Emplacer." U.S. Pat. No. 5,351,949 discloses a "Putter-Mounted Holder for Golf Ball Position Marker." U.S. Pat. No. 5,690,558 discloses a "Golf Ball Retriever."

The devices developed heretofore have had various shortcomings. A need presently exists for a device which can be used on the end of a putter or other golf club to facilitate turf repair tasks (e.g., ball mark repair or divot replacement) or other golf-related tasks but which (a) can be incorporated in an existing club, (b) does not significantly change the look or feel of either the golf club or the golf club grip, (c) allows the golfer to perform turf repair or other golf-related tasks without having to significantly stoop, squat, or bend down, (d) allows a turf repair tool or other tool to be easily attached to and removed from the grip end of the golf club, (e) holds the tool securely such that the tool will not turn with respect to or become separated from the golf club while performing the task, and (f) utilizes a tool which, when not in use, can be comfortably held in the golfer's pants pocket.

SUMMARY OF THE INVENTION

The present invention provides an apparatus for facilitating golf-related tasks. The inventive apparatus addresses the problems and satisfies the needs mentioned above. In one aspect, the inventive apparatus comprises: a plug positionable in a distal end of a golf club shaft and having an aperture extending into the plug; a tool; and a tool shaft extending from the tool and having a distal end portion removably receivable in the aperture. The distal end portion of the tool shaft has a configuration and the aperture has an interior shape corresponding to said configuration such that, when the distal end portion of the tool shaft is received in the aperture, the tool is prevented from rotating with respect to the plug.

In another aspect, the present invention provides an apparatus for facilitating golf-related tasks comprising: a plug held in a distal end of a golf club shaft and having a plug aperture extending into an outer end of the plug; a tool; and a tool shaft extending from the tool and having a distal end portion removably receivable in the plug aperture. The distal end portion of the tool has a configuration and the plug aperture has an interior shape corresponding to said configuration such that, when the distal end portion of the tool shaft is received in the plug aperture, the tool is prevented from rotating with respect to the golf club shaft.

In another aspect, the present invention provides an apparatus for golf turf repair comprising: a golf club shaft having a cavity provided in the distal end thereof; a turf repair tool; a tool shaft extending from the turf repair tool and having a shaft distal end portion removably receivable in the cavity; and a golf club grip secured on the distal end of the golf club shaft and including a grip end portion positioned over the cavity. The shaft distal end portion has a configuration and the cavity has an interior shape corresponding to said configuration such that, when the shaft distal end portion is received in the cavity, the turf repair tool is prevented from rotating with respect to the golf club shaft. The grip end portion has a resilient aperture extending therethrough such that the shaft distal end portion is receivable in and removable from the cavity by delivering the shaft distal end portion through the resilient aperture. The resilient aperture is sized such that the resilient aperture expands when the shaft distal end portion is delivered therethrough. Further, when the shaft distal end portion is positioned in the cavity, the resilient aperture will contract against the tool shaft to removably retain the shaft distal end portion in the cavity.

Further objects, features, and advantages of the invention will be apparent upon examining the accompanying drawings and upon reading the following description of the preferred embodiment.

DESCRIPTION OF THE PREFERRED EMBODIMENTS

Figure 1:
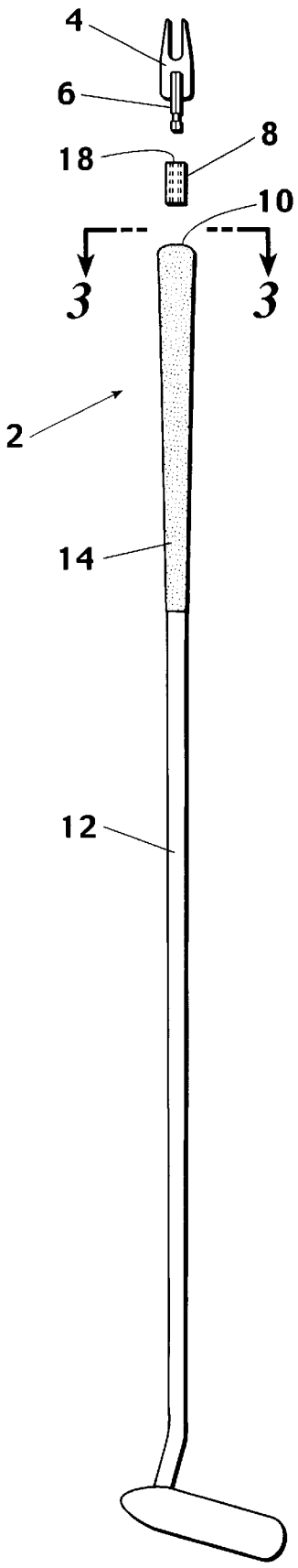
FIG. 1 provides an exploded, elevational view of an embodiment 2 of the inventive apparatus.
Figure 3:
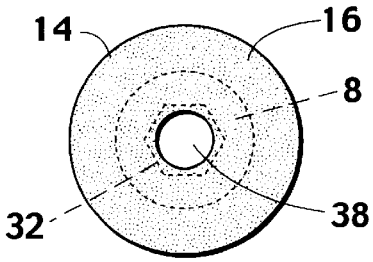
FIG. 3 provides an end view of a golf club grip, as viewed from perspective 3—3 shown in FIG. 1, of a type preferred for use in inventive apparatus 2.
Figure 2:
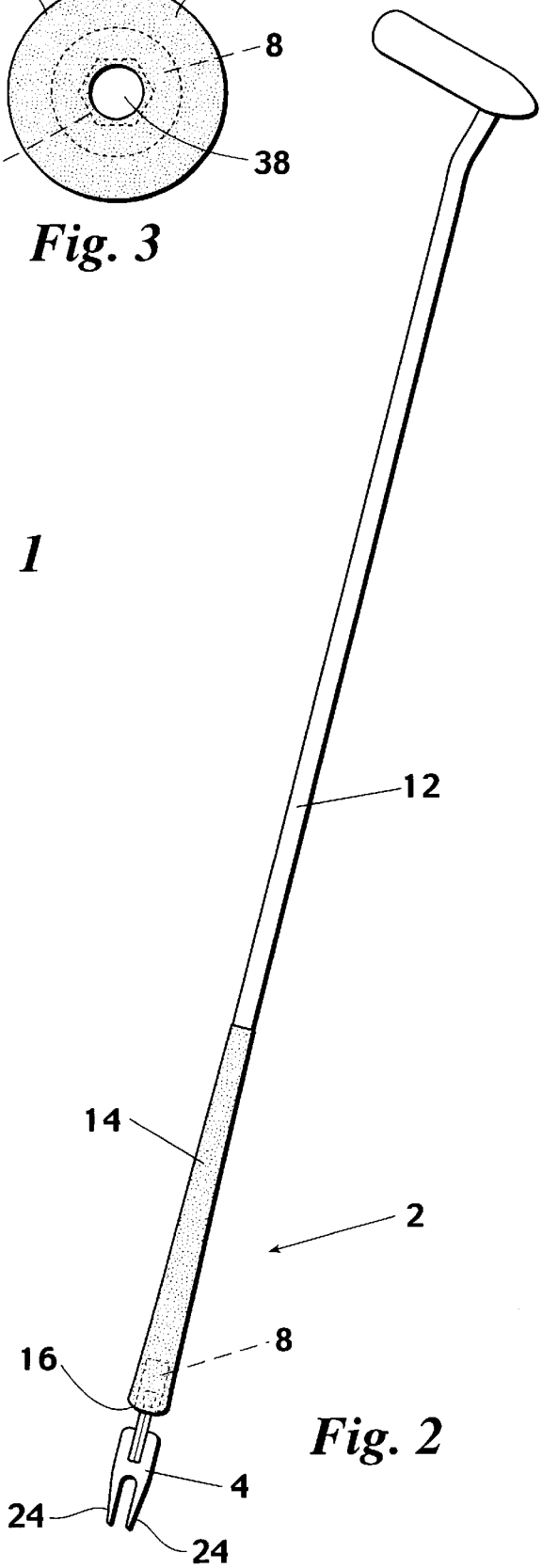
FIG. 2 provides a non-exploded, elevational view of inventive apparatus 2.

An embodiment 2 of the inventive apparatus is depicted in FIGS. 1–7. The inventive apparatus preferably comprises: a tool 4 having a tool shaft 6 extending therefrom; a plug 8 positionable in the distal end 10 of a golf club shaft 12; and a golf club grip 14 secured on the distal end portion of the club shaft 10 such that the butt end 16 of grip 14 is positioned over the outer end 18 of plug 8.

Tool 4 can be generally any type of tool. By way of example, but not by way of limitation, tool 4 could be (a) a ball mark repair tool; (b) a divot replacement tool; (c) a golf ball retrieving tool; (d) a ball mark placement and/or retrieval tool; or (e) any combination of thereof. Tool 4 will most preferably be of a size and shape such that, when not in use, tool 4 can be conveniently and comfortably retained in the golfer's pants pocket. A used herein, the term "comfortably" means that, when placed in the golfer's pants pocket, the tool will not cause discomfort or interfere with the golfer's game and will not distract the golfer.

Figure 4:
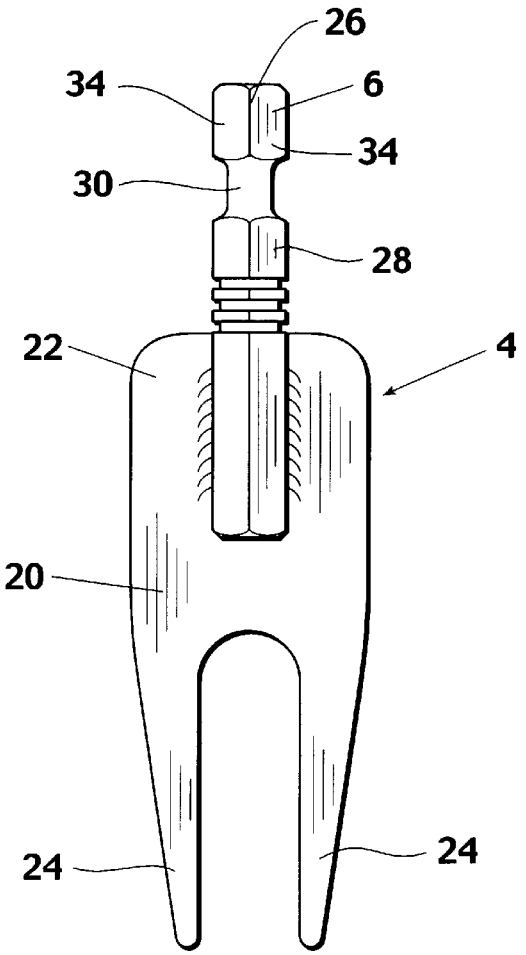
FIG. 4 provides an elevational front view of a turf repair tool 4 preferred for use in the inventive apparatus.
Figure 5:
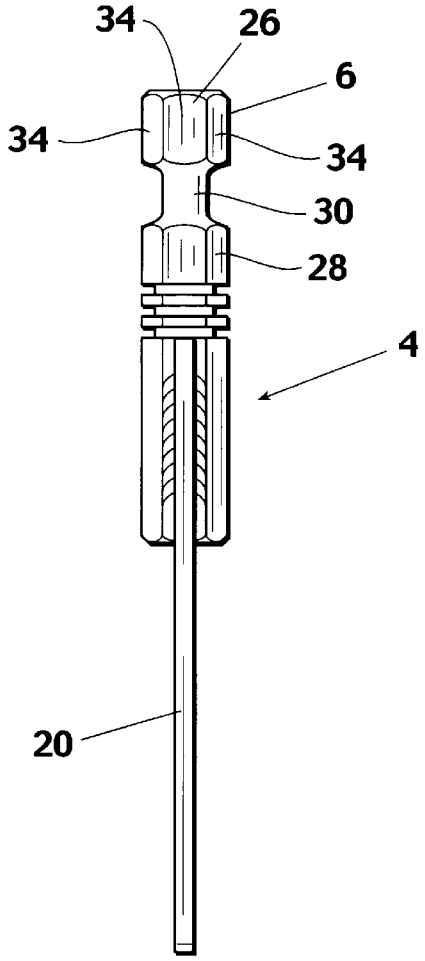
FIG. 5 provides an elevational side view of turf repair tool 4.

Tool 4 depicted in FIGS. 1, 4, and 5, is a turf repair tool comprising a flat body 20 having a base 22 and at least a pair of elongate prongs 24 extending from base 22. The shaft 6 of tool 4 is rigidly secured to and extends rearwardly from base 22. Tool 4 is particularly well suited for ball mark repair tasks.

Tool shaft 6 preferably includes: a distal end portion 26; a proximal or intermediate portion 28 extending between distal end portion 26 and base 22; and a groove 30 formed in and around intermediate portion 28 and positioned adjacent to distal end portion 26.

Figure 7:
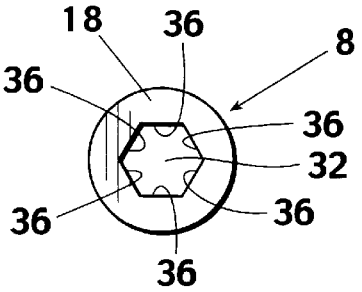
FIG. 7 provides an end view of plug 8.
Figure 6:
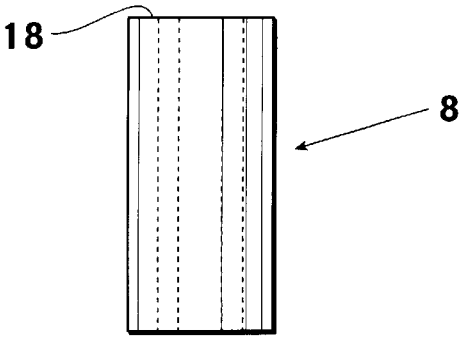
FIG. 6 provides a longitudinal view of a plug 8 of a type preferred for use in the inventive apparatus.

Plug 8 is sized and shaped for placement in the distal end 10 of club shaft 12. As shown in FIGS. 6 and 7, plug 8 is preferably a substantially cylindrical bushing having a size substantially corresponding to the interior of the distal end 10 of club shaft 12. Plug 8 is preferably permanently installed, in fixed position, in the distal end 10 of club 12. Examples of suitable methods of permanently securing plug 8 in club shaft 12 include gluing, press fitting, tacking, placing shims around the plug, or swedging and then shrinking the end of club shaft 12. One simple method of installing plug 8 includes the steps of: (1) applying a sufficient amount of tape to the exterior of plug 8 to provide a tight fit within the end 10 of club shaft 12; (2) applying glue to the exterior of the taped plug; pressing the taped plug 8 into distal end 10; and then (4) allowing the glue to dry and/or cure so that plug 8 is permanently secured in fixed position in the distal end of club shaft 12.

Plug 8 has a sprocket opening 32 extending into the outer end 18 thereof for receiving the distal end portion 26 of tool shaft 6. Shaft end portion 26 and sprocket opening 32 have corresponding shapes such that, when shaft end portion 26 is placed in sprocket opening 32, tool 4 is prevented from rotating with respect to plug 8. For example, shaft end portion 26 and sprocket opening 32 can include one or more flat surfaces, keys, splines, or other such configurations commonly used for preventing shaft rotation. In the embodiment depicted in FIGS. 4–7, shaft end portion 26 has a plurality of flat, longitudinal surfaces 34 formed thereon and sprocket opening 32 has a plurality of corresponding flat surfaces 36 formed therein such that shaft end portion 26 and sprocket opening 32 have corresponding polygonal, cross-sectional shapes. FIGS. 4–6 specifically disclose a shaft end portion 26 and sprocket opening 32 having mating hexagonal shapes.

Grip 14 is preferably a standard grip of the type commonly used on putters and other golf clubs. The butt end 16 of grip 14 covers the outer end 18 of plug 8 and has an aperture 38 formed therethrough for removably receiving shaft distal end portion 26. Aperture 38 is preferably a circular hole. Preferably, aperture 38 is slightly smaller than sprocket opening 32 (see FIG. 3) and the end 16 of grip 14 is formed from an at least slightly resilient material such that aperture 38 will expand sufficiently to allow the distal end portion 26 of shaft 6 to be placed in and pulled from sprocket opening 32. Aperture 38 is most preferably sized and shaped such that, after shaft end portion 26 is pushed into sprocket 32, aperture 38 will contract into and around shaft groove 30 and thus effectively grip tool shaft 6 sufficiently to (a) retain shaft end portion 26 in sprocket opening 34 during normal use but (b) allow the golfer to easily remove the tool 4 following such use.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An apparatus for facilitating golf-related tasks comprising:

a plug positionable in a distal end of a golf club shaft and having an aperture extending into said plug;

a tool; and a tool shaft extending from said tool and having a distal end portion removably receivable in said aperture, wherein said distal end portion of said tool shaft has a configuration and said aperture has an interior shape corresponding to said configuration such that, when said distal end portion of said tool shaft is received in said aperture, said tool is prevented from rotating with respect to said plug, said configuration comprising at least one flat, longitudinal surface.

2. The apparatus of claim 1 comprising a plurality of said flat, longitudinal surfaces arranged such that said distal end portion of said tool shaft has a substantially polygonal cross-sectional shape.

3. The apparatus of claim 1 wherein said tool shaft further includes a groove provided around the exterior thereof adjacent said distal end portion.

4. The apparatus of claim 1 wherein said tool is a turf repair tool.

5. The apparatus of claim 4 wherein said turf repair tool comprises a base portion having at least two prongs extending therefrom.

6. The apparatus of claim 5 wherein said tool shaft rigidly extends from said base portion.

7. An apparatus for facilitating golf-related tasks comprising:

a plug, held in a distal end of a golf club shaft and having a plug aperture extending into an outer end of said plug;

a tool; and a tool shaft extending from said tool and having a distal end portion removably receivable in said plug aperture, wherein said distal end portion of said tool shaft has a configuration and said plug aperture has an interior shape corresponding to said configuration such that, when said distal end portion of said tool shaft is received in said plug aperture, said tool is prevented from rotating with respect to said golf club shaft;

said apparatus further comprising a cover secured on said distal end of said golf club shaft;

said cover being positioned over said outer end of said plug;

said cover having a cover aperture extending therethrough;

said distal end portion of said tool shaft being receivable through said cover aperture for placing said distal end portion of said tool shaft in said plug aperture; and said cover aperture being resilient and being sized such that said cover aperture will expand as said distal end portion of said shaft is received therethrough.

8. The apparatus of claim 7 wherein said configuration comprises at least one flat, longitudinal surface.

9. The apparatus of claim 8 comprising a plurality of said flat, longitudinal surfaces arranged such that said distal end portion of said tool shaft has a substantially polygonal cross-sectional shape.

10. The apparatus of claim 7 wherein said tool is a turf repair tool.

11. The apparatus of claim 10 wherein said turf repair tool comprises a base portion having at least two prongs extending therefrom.

12. The apparatus of claim 11 wherein said tool shaft rigidly extends from said base portion.

13. The apparatus of claim 8 wherein said tool shaft is configured such that, when said distal end portion of said tool shaft is received through said cover aperture, said cover aperture contracts against said tool shaft to releasably retain said distal end portion of said tool shaft in said plug aperture.

14. The apparatus of claim 13 wherein said tool shaft further includes a groove, provided around the exterior thereof, into which said cover aperture contracts when said distal end portion of said tool shaft is received in said plug aperture.

15. The apparatus of claim 7 wherein said cover is an end portion of a golf club grip.

16. An apparatus for golf turf repair comprising:

a golf club shaft having a distal end and a cavity provided in said distal end;

a turf repair tool;

a tool shaft extending from said turf repair tool and having a shaft distal end portion removably receivable in said cavity, said shaft distal end portion having a configuration and said cavity having an interior shape corresponding to said configuration such that, when said shaft distal end portion is received in said cavity, said turf repair tool is prevented from rotating with respect to said golf club shaft; and a golf club grip secured on said distal end of said golf club shaft and including a grip end portion positioned over said cavity, said grip end portion having a resilient aperture extending therethrough such that said shaft distal end portion is receivable in and removable from said cavity by delivering said shaft distal end portion through said resilient aperture, said resilient aperture being sized such that said resilient aperture expands when said shaft distal end portion is delivered therethrough, and wherein, when said shaft distal end portion is positioned in said cavity, said resilient aperture will contract against said tool shaft to removably retain said shaft distal end portion in said cavity.

* * * * *